United States Patent [19]

Ida

[11] 4,205,523

[45] Jun. 3, 1980

[54] CASE BODY CONSTRUCTION FOR TIMEPIECES

[75] Inventor: Katsuji Ida, Tokyo, Japan

[73] Assignee: Kabushiki Kaisha Daini Seikosha, Japan

[21] Appl. No.: 912,174

[22] Filed: Jun. 5, 1978

Related U.S. Application Data

[63] Continuation of Ser. No. 730,383, Oct. 6, 1976, abandoned.

[30] Foreign Application Priority Data

Oct. 8, 1975 [JP] Japan ..... 52-121571
Dec. 5, 1975 [JP] Japan ..... 52-165083[U]

[51] Int. Cl.[2] ..... G04B 37/08
[52] U.S. Cl. ..... 368/281
[58] Field of Search ..... 58/88 R, 88 C, 90 R, 58/90 B, 91, 92, 94

[56] References Cited

U.S. PATENT DOCUMENTS 2,719,403 10/1955 Gisiger ..... 58/90 R
3,479,771 11/1969 Stemann ..... 58/90 R
4,059,957 11/1977 Monnet ..... 58/90 R

FOREIGN PATENT DOCUMENTS 1069533 11/1959 Fed. Rep. of Germany ..... 58/90 A
568606 10/1975 Switzerland ..... 58/88 R

*Primary Examiner*—Vit W. Miska
*Attorney, Agent, or Firm*—Robert E. Burns; Emmanuel J. Lobato; Bruce L. Adams

[57] ABSTRACT

A timepiece case having an open back, and a case back cover for closing the back of the timepiece. A ring is attached to the back cover for projecting into the timepiece case when the back cover is in position covering the open back of the timepiece case. The back cover ring is dimensioned to fit snugly within the timepiece case and has an internal diameter sufficient to clear a timepiece movement as the back cover is attached to and removed from the timepiece case body. A timepiece movement holding ring of resilient material is dimensioned to fit snugly within the timepiece case for positioning and holding a timepiece movement therein. The holding ring has an opening dimensioned to receive and snugly hold in position a timepiece movement, and the holding ring has an upper peripheral surface for supporting a peripheral flange of the timepiece movement and for holding a face of the timepiece movement against a front of the timepiece case. The holding ring has resilient projections abutting the back cover ring for maintaining the holding ring in position between the flange of the timepiece movement and the back cover ring.

3 Claims, 7 Drawing Figures

FIG. 1
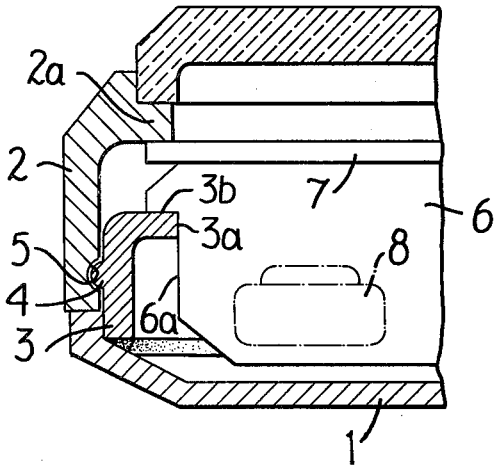
FIG. 2
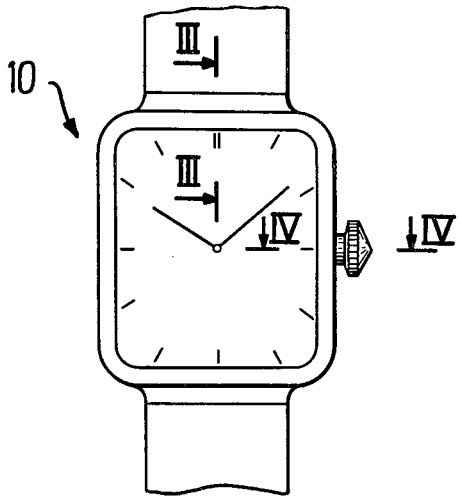
FIG. 3
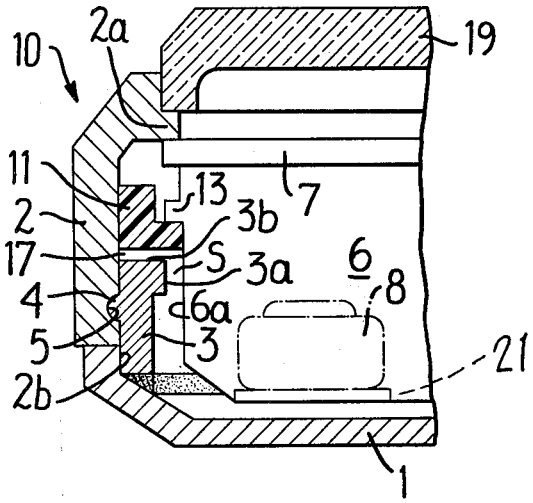
FIG. 4
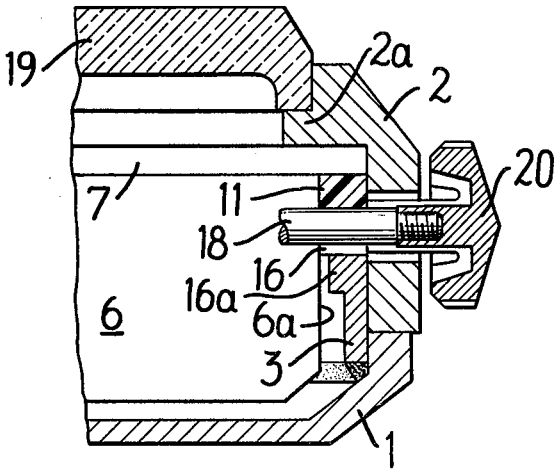
FIG. 5
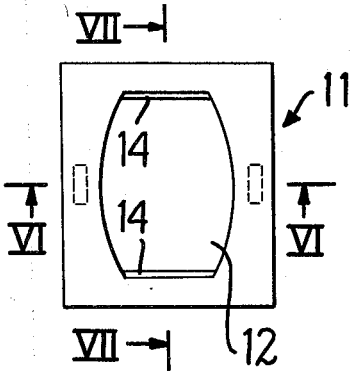
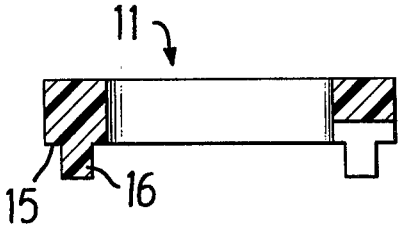
FIG. 6
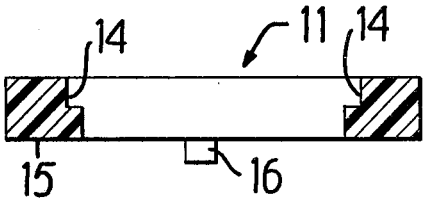
FIG. 7

CASE BODY CONSTRUCTION FOR TIMEPIECES

This is a continuation of application Ser. No. 730,383, filed Oct. 7, 1976, now abandoned.

BACKGROUND OF THE INVENTION

This invention relates to an improvement of the case for a timepiece.

A conventional timepiece is illustrated in FIG. 1 in which a case body comprises a case back cover 1, a case body 2, and a casing ring 3 which is secured to the case back cover 1. A timepiece movement 6 which operates dial hands is held within said case by the engagement of a projection 4 of the casing ring 3 with the recess 5 of said case body. This casing ring limits the lateral displacement of the movement 6 by its top wall 3*a* and regulates the axial displacement by holding a flange thereof between its upper surface 3*b* and the upper protruding portion 2*a* of the case body 2 through mediation of the dial plate 7. If an electric cell is used as a power source of the movement 6, said electric cell must be exchanged after its available operating period is exceeded.

The exchanging operation is accomplished by taking off the case back 1, but when the projection 4 of the casing ring 3 is out of the recess 5 of the case body 2, the top wall 3*a* of the casing ring damages the side wall 6*a* of the timepiece movement 6 and in turn there is a danger that the casing ring will be bent therefrom. Also the casing ring is such an essential element for holding the movement that it must be reshaped in case of re-assembling of the timepieces.

SUMMARY OF THE INVENTION

The object of this invention is to provide watch or timepiece case which is characterized in that a resilient holding ring absorbs forces tending to cause lateral displacement of the movement and moreover a resilient downwardly protruding portion formed under said holding ring is held between the upper protruding portion 2*a* of the case body 2 and the upper surface 3*b* of the holding ring so that forces tending to cause axial displacement of the movement are absorbed and is characterized in that some clearance is present between the holding ring and the side wall of the movement so that damage to the side wall of the movement is prevented even if the casing ring is deformed during assembly. Consequently, the electric cell housed in the movement can be more easily exchanged.

BRIEF DESCRIPTION OF THE DRAWINGS

FIG. 1 is a cross-sectional view of the conventional portable timepieces.

FIG. 2 is a plan view of the portable timepiece according to the present invention.

FIGS. 3 and 4 are cross-sectional views along III—III or IV—IV respectively.

FIG. 5 is a plan view of the holding ring illustrated in FIGS. 3 and 4.

FIGS. 6 and 7 are cross-sectional views of the holding ring of FIG. 5 along lines VI—VI or VII—VII.

DESCRIPTION OF THE PREFERRED EMBODIMENT

An embodiment of the watch cases of our invention is described in conjunction with the following drawings. FIG. 3 shows a cross-sectional view along line III—III of FIG. 2 (The same member illustrated in FIG. 1 is marked of the same reference number).

In FIG. 3a timepiece 10 comprises a case back cover 1 and a case body 2. This case back cover 1 is secured with the casing ring or case back cover ring 3 by welding.

The casing ring 3 is formed with the projection 4 which is disposed circumferentially inside of the case back 1 and is engageable with the recess 5 of the case body 2 and the inside wall of the casing ring has a slightly protruding portion 3*a*. Accordingly there is a clearance S between the side wall 6*a* of the timepiece movement 6 and said protruding portion. The timepiece movement holding ring 11 in FIG. 5 positioned on the casing ring 3 has an opening 12 in which the movement 6 mounted with the centrally positioned dial hands can be inserted and has a stepped portion or shoulder 14 partially disposed inside of the opening 12 on which the flange portion 13 of the movement 6 is mounted. This holding ring 11 is made of resilient materials (for example synthetic resin) and is formed having two projection 16 on its rear face 15. The timepiece movement holding ring 11 shoulder portion 14 includes two diametrically opposed portions each for supporting a respective diametrically opposed flange portion 13 of the timepiece movement 6. The resilient projections 16 are also diametrically opposed and are positioned adjacent sides of the opening 12 which are free of the pair of shoulder portions 14. Therefore if the holding ring 11 is mounted on the casing ring, as shown in FIG. 3, a hollow space 17 between the upper face of the casing ring 3 and the lower face 15 of the holding ring 11 is produced at the 12 hour and 6 hour position in FIG. 2, and also said projection 16 abuts against the upper face of the casing ring at the 3 hour and 9 hour position as shown in FIG. 4. As FIG. 4 shows a cross sectional view of the 3 hour position, said projection 16 is partially cut away and the winding stem 18 extends therethrough and the lower face 16*a* of said projection abuts against the upper face of the casing ring 3. Reference numeral 19 is a crystal glass and reference numeral 20 is a crown.

Next, the assembling operation of the above described structure and the exchanging operation of the electric cell are described.

The assembling operation in which the movement 6 is inserted inside of the case body 2 of the timepiece 10 is as follows. A movement 6 is mounted within the opening 12 of the holding ring 11 and a dial plate 7 is mounted thereon and they are inserted inside of the case body 2. Next a case back cover 1 with the casing ring is inserted into the inside of the case body 2 and eventually a movement 6 is assembled into the case body 2 of the timepiece 10. With this structure, the casing ring 3 has such a slight resiliency that it is inwardly bent as far as the height of the projection 4 by its abutting against the inner face 2*b* of the case body 2 and a hollow space S is maintained between the side wall 6*a* of the movement 6 and said casing ring so that the side wall 6*a* is free from damage. When the projection 4 is engaged with the recess 5, the holding ring 11 is not abutted against the casing ring at the 12 hour and 6 hour position (which is illustrated in FIG. 3), but the projection 16 of the holding ring is abutted against the upper face of the casing ring at the 3 hour and 9 hour position and said holding ring 11 and the dial plate mounted thereon are held between the case body 2 and the casing ring 3. Accordingly lateral displacement of the movement 6 is prevented by the inner peripheral surface of the holding ring 11, and axial displacement is prevented by the projection 16 of the ring 11.

The exchanging operation of the electric cell 8 is as follows. The case back 1 is removed. As this is done the casing ring 3 is inwardly flexed by the projection 4, but the side wall 6*a* of the movement 6 is prevented from being damaged by the presense of the hollow space S. When the electric cell housed within the movement is exchanged, the cell cover 21 has to be rotated by a 10-yen coin, but the movement 6 is held in the resilient holding ring 11 which opposes a force tending to rotate the movement and the force is absorbed. The assembling operation of the case after the electric cell is exchanged, is a reverse of the operation set forth above.

According to the timepiece of this invention, a resilient holding ring secures the timepiece movement therein, and is formed having a projection in the side face which abuts against the casing ring and is held between the case body and the case back with the casing ring so that lateral or axial displacement of the timepiece movement in exchanging the electric cell, can be prevented. Accordingly the exchanging operation of the cell is made easier and the adjusting operation of the shape of the casing ring which is necessary in exchanging the conventional cell, become unnecessary and the conventional two-piece case can be produced in the same dimension.

What I claim is:

1. A timepiece case, comprising:

a timepiece case body having side walls defining an interior of the timepiece case, an open back, and a front having an opening therethrough bounded by a peripheral projecting portion, and wherein said side walls have a recess in the interior of the case;

a back cover for said timepiece case including a ring attached thereto for projecting into said timepiece case when the back cover is in position covering the open back of said timepiece case, said back cover ring having a plain annular end surface facing said timepiece case front and said back cover ring being dimensioned to fit snugly within said timepiece case and including an external projection for engaging the recess of the timepiece case side walls for securing said back cover to said timepiece case, and said back cover ring having an internal diameter sufficient to clear a timepiece movement as said back cover is attached to and removed from said timepiece case body; and a timepiece movement holding ring consisting essentially of a single piece of resilient material dimensioned to fit snugly within said timepiece case for positioning and holding a timepiece movement within said timepiece case, said holding ring having an opening dimensioned to receive and snugly hold in position a timepiece movement and said holding ring having a pair of diametrically opposed upper peripheral shoulder portions for supporting respective diametrically opposed peripheral flanges of a timepiece movement, and said holding ring having a pair of diametrically opposed resilient projections abutting said plain annular back cover ring face for maintaining said holding ring in position between the flange of the timepiece movement and said back cover ring, said pair of resilient projections being positioned adjacent sides of said opening which are free of said pair of peripheral shoulder portions and which sides are effective to hold a face of the timepiece movement against said front peripheral projecting portion of said timepiece case.

2. A timepiece case according to claim 1, in combination with a timepiece movement having a pair of diametrically opposed peripheral flanges, said timepiece movement being inserted within said holding ring and said flanges resting on top of said peripheral shoulder portions of said holding ring with said timepiece movement bearing directly against said peripheral projecting portion of said timepiece case body.

3. A timepiece case according to claim 1, wherein said timepiece case is rectangular, and wherein the opening through said timepiece movement holding ring is rectangular for receiving and snugly holding a rectangular timepiece movement.

* * * * *

UNITED STATES PATENT AND TRADEMARK OFFICE

CERTIFICATE OF CORRECTION

PATENT NO. : 4,205,523

DATED : June 3, 1980

INVENTOR(S) : IIDA

It is certified that error appears in the above-identified patent and that said Letters Patent are hereby corrected as shown below:

Change the name of the inventor to read as follows:

--Katsuji Iida--.

Signed and Sealed this

*Eighteenth* Day of *November 1980*

[SEAL]

*Attest:*

SIDNEY A. DIAMOND

*Attesting Officer*

*Commissioner of Patents and Trademarks*